US012066025B2

(12) United States Patent
Dargham et al.

(10) Patent No.: US 12,066,025 B2
(45) Date of Patent: Aug. 20, 2024

(54) SCROLL COMPRESSOR PROVIDED WITH A DISCHARGE MUFFLER ARRANGEMENT

(71) Applicant: Danfoss Commercial Compressors, Trevoux (FR)

(72) Inventors: Remi Bou Dargham, Villeurbanne (FR); Alain Laville, Trévoux (FR); Arnaud Daussin, Trevoux (FR); Jean-Jacques Laissus, Reyrieux (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 0 days.

(21) Appl. No.: 17/959,573

(22) Filed: Oct. 4, 2022

(65) Prior Publication Data

US 2023/0167825 A1 Jun. 1, 2023

(30) Foreign Application Priority Data

Nov. 26, 2021 (FR) ..... 21/12577

(51) Int. Cl.
*F04C 29/06* (2006.01)
*F04C 18/02* (2006.01)
*F04C 23/00* (2006.01)

(52) U.S. Cl.
CPC ..... *F04C 29/068* (2013.01); *F04C 18/0215* (2013.01); *F04C 29/065* (2013.01); *F04C 23/008* (2013.01)

(58) Field of Classification Search
CPC .. F04C 23/008; F04C 18/0215; F04C 29/068; F04C 29/065; F04C 29/12;
(Continued)

(56) References Cited

U.S. PATENT DOCUMENTS 4,145,167 A 3/1979 Baatrup
4,412,415 A 11/1983 Thomsen et al.
(Continued)

FOREIGN PATENT DOCUMENTS

CN 202468152 U 10/2012
CN 106194755 A 12/2016
(Continued)

OTHER PUBLICATIONS

JP-2001159304-A, English Language Machine Translation (Year: 2001).*

*Primary Examiner* — Wesley G Harris
(74) *Attorney, Agent, or Firm* — McCormick, Paulding & Huber PLLC

(57) ABSTRACT

The scroll compressor includes a compressor shell having a discharge outlet; an orbiting scroll; a fixed scroll including a discharge passage (16); a discharge pressure volume (17) at least partially defined by the compressor shell and the fixed scroll (7); a discharge muffler arrangement (21) attached to the fixed scroll (7) and arranged in the discharge pressure volume (17), the discharge muffler arrangement (21) including a first tubular element (28) provided with a muffler inlet (29) fluidly connected to the discharge passage (16), an expansion chamber (33) fluidly connected to an inner volume of the first tubular element (28), and a second tubular element (35) including an inlet opening emerging in the expansion chamber (33) and an outlet opening fluidly connected to the discharge pressure volume (17).

18 Claims, 3 Drawing Sheets

(58) Field of Classification Search
CPC ..... F04C 2240/30; F04C 18/0253; F04C 18/0246; F04B 39/121; F04B 39/0061; F04B 39/00
USPC .... 418/55.1, 181, 55.4, 312; 417/410.5, 312
See application file for complete search history.

(56) References Cited

U.S. PATENT DOCUMENTS

| | | | | |
|---|---|---|---|---|
| 5,136,844 | A | 8/1992 | Stephenson et al. | |
| 5,208,429 | A * | 5/1993 | Field | F02M 35/1233 181/254 |
| 5,667,371 | A | 9/1997 | Prenger et al. | |
| 6,071,102 | A | 6/2000 | Hjelsand | |
| 9,217,430 | B2 | 12/2015 | Smith et al. | |
| 10,723,378 | B2 | 7/2020 | Arbjerg et al. | |
| 2009/0068048 | A1* | 3/2009 | Stover | F04C 18/0215 418/142 |
| 2015/0345498 | A1* | 12/2015 | Ziehr | F04C 27/008 418/228 |
| 2021/0003131 | A1 | 1/2021 | Iwatake et al. | |

FOREIGN PATENT DOCUMENTS

| | | | | |
|---|---|---|---|---|
| DE | 10 2004 055 710 | B3 | 7/2006 | |
| EP | 0872642 | A1 * | 10/1998 | F04C 18/02 |
| EP | 1067289 | A2 * | 1/2001 | F04C 23/008 |
| EP | 2 610 140 | A1 | 7/2013 | |
| EP | 3 078 570 | A1 | 10/2016 | |
| EP | 3 078 571 | A1 | 10/2016 | |
| EP | 3358191 | A2 * | 8/2018 | F04C 18/0215 |
| JP | S60-3356 | Y2 | 1/1985 | |
| JP | H04-82391 | U | 7/1992 | |
| JP | 2001159304 | A * | 6/2001 | |
| KR | 10-0446214 | B1 | 8/2004 | |

* cited by examiner

SCROLL COMPRESSOR PROVIDED WITH A DISCHARGE MUFFLER ARRANGEMENT

CROSS-REFERENCE TO RELATED APPLICATION

This application claims foreign priority benefits under U.S.C. § 119 from French Patent Application No. 21/12577, filed Nov. 26, 2021, the content of which is hereby incorporated by reference in its entirety.

TECHNICAL FIELD

The invention relates to a scroll compressor provided with a deflector arranged in a discharge pressure volume delimited by a fixed scroll and a compressor shell.

BACKGROUND

As known, a scroll compressor includes:

a compressor shell having a discharge outlet, an orbiting scroll arranged within the compressor shell and comprising an orbiting base plate and an orbiting spiral wrap extending from the orbiting base plate, a fixed scroll arranged within the compressor shell and comprising a fixed base plate and a fixed spiral wrap extending from the fixed base plate, the fixed and orbiting spiral wraps defining, with the fixed and orbiting base plates, compression chambers, the fixed scroll further comprising a discharge passage which is formed in the fixed base plate, and a discharge pressure volume at least partially defined by the compressor shell and the fixed scroll, and being fluidly connected to the discharge passage.

A major part of the acoustic noise emitted from such a scroll compressor is due to the flow of compressed refrigerant gas from the fixed scroll into the discharge pressure volume, typically formed in the upper portion of the compressor shell.

To address this problem, acoustic mufflers are known to be arranged within the discharge pressure volume of the scroll compressor to damp acoustic noise emitted through the upper shell portion.

U.S. Pat. No. 5,667,371 discloses a scroll compressor with a muffler assembly comprising a perforated muffler and a top cap surrounding the perforated muffler and being attached to a partition wall arranged inside the compressor shell between a suction volume and a discharge pressure volume. Openings formed in the top cap communicate the compressed refrigerant gas, which all have passed the perforations of the muffler, with a discharge chamber of the scroll compressor.

CN106194755 discloses a scroll compressor with a muffler assembly attached to the fixed end plate of a fixed scroll, the muffler assembly comprising an expansion chamber communicating with a discharge port of the fixed scroll and a discharge pipe. The muffler assembly is further comprising a closed cavity communicating with a perforated portion of the discharge pipe.

However, while providing improved acoustic noise damping through scattering, reflections and interference of sound waves, such muffler assemblies show increased flow restrictions and pressure losses and thereby influence overall efficiency of the scroll compressor in a negative way.

SUMMARY

It is an object of the present invention to provide an improved scroll compressor, which can overcome the drawbacks encountered in conventional scroll compressors.

Another object of the present invention is to provide a scroll compressor with a discharge muffler arrangement arranged in the discharge pressure volume of the scroll compressor, ensuring improved sound attenuation without decreasing the compressor efficiency.

According to the invention such a scroll compressor includes:

a compressor shell having a discharge outlet, an orbiting scroll arranged within the compressor shell and comprising an orbiting base plate and an orbiting spiral wrap extending from the orbiting base plate, a fixed scroll arranged within the compressor shell and comprising a fixed base plate and a fixed spiral wrap extending from the fixed base plate, the fixed and orbiting spiral wraps defining, with the fixed and orbiting base plates, compression chambers, the fixed scroll further comprising a discharge passage which is formed in the fixed base plate, a discharge pressure volume at least partially defined by the compressor shell and the fixed scroll, a discharge muffler arrangement attached to the fixed scroll, and particularly to the fixed base plate, and arranged in the discharge pressure volume, wherein the discharge muffler arrangement includes a first tubular element provided with a muffler inlet fluidly connected to the discharge passage, an expansion chamber fluidly connected to an inner volume of the first tubular element, and a second tubular element including an inlet opening emerging in the expansion chamber and an outlet opening fluidly connected to the discharge pressure volume.

Such a configuration of the discharge muffler arrangement, and particularly the provision on the one hand of a first tubular element provided with a muffler inlet and on the other hand of an expansion chamber fluidly connected to the discharge pressure volume through a second tubular element, provides an improved acoustic noise damping (through scattering, reflections and interference of sound waves) while reducing the pressures losses within the discharge muffler arrangement.

Consequently, the acoustic behavior and the efficiency of the scroll compressor according to the present invention are substantially improved compared to the acoustic behavior and the efficiency of the scroll compressors of the prior art.

The scroll compressor may also include one or more of the following features, taken alone or in combination.

According to an embodiment of the invention, the discharge muffler arrangement extends over the discharge passage.

According to an embodiment of the invention, the discharge muffler arrangement includes a plurality of attachment tabs which are secured to the fixed scroll, for example by use of screws or bolts. However, other suitable methods, e.g. welding, brazing or gluing may be applied to attach the discharge muffler arrangement to the fixed scroll.

According to an embodiment of the invention, the compressor shell includes an upper cap, and the discharge muffler arrangement is arranged in the discharge pressure volume such that a clearance is defined between the upper cap and an upper surface of the discharge muffler arrangement.

According to an embodiment of the invention, the first tubular element and the second tubular element extend substantially parallel to each other.

According to an embodiment of the invention, the first tubular element and/or the second tubular element extend(s) substantially vertically.

According to an embodiment of the invention, the first tubular element has a circular cross-section.

According to an embodiment of the invention, the second tubular element has a circular cross-section.

According to an embodiment of the invention, the first tubular element comprises a first tubular wall portion adjacent to the muffler inlet and delimiting an inlet chamber, and a second tubular wall portion comprising apertures opening into the expansion chamber.

According to an embodiment of the invention, the first tubular element includes a first open end defining the muffler inlet and a second open end which is remote from the muffler inlet and which is fluidly connected to the discharge pressure volume.

According to an embodiment of the invention, the second tubular element includes a first open end defining the inlet opening and a second open end defining the outlet opening.

According to an embodiment of the invention, the second open end of the first tubular element opens into the discharge pressure volume.

According to an embodiment of the invention, the outlet opening of the second tubular element opens into the discharge pressure volume. Thus, the second tubular element fluidly communicates the expansion chamber with the discharge pressure volume.

According to an embodiment of the invention, the discharge muffler arrangement includes an outlet chamber provided with a muffler outlet emerging in the discharge pressure volume.

According to an embodiment of the invention, the muffler outlet emerges in the discharge pressure volume at a predetermined separating distance from the discharge outlet to allow communication between the discharge pressure volume and a compressed refrigerant gas flow emerging from the muffler outlet.

According to an embodiment of the invention, the muffler outlet is directed towards the discharge outlet provided on the compressor shell. Also hereby, a more smooth and direct flow from the discharge muffler arrangement towards the discharge outlet with minimized turbulences and pressure losses is created, which contributes to improve the efficiency of the scroll compressor. Further, the relatively hot and pulsating compressed refrigerant gas flow is prevented from directly hitting the inner surface of the upper cap of the compressor shell, thereby reducing the acoustic noise and the outer surface temperature of said upper cap.

According to an embodiment of the invention, the second open end of the first tubular element opens into the outlet chamber.

According to an embodiment of the invention, the outlet opening of the second tubular element opens into the outlet chamber. Thus, the second tubular element fluidly communicates the expansion chamber with the outlet chamber.

According to an embodiment of the invention, the second tubular element is at least partially arranged in the outlet chamber.

According to an embodiment of the invention, the discharge muffler arrangement includes a bottom wall, a side wall and an intermediate wall, the expansion chamber being delimited by the bottom wall, the side wall, the first tubular element and the intermediate wall.

According to an embodiment of the invention, the outlet chamber is located above the expansion chamber.

According to an embodiment of the invention, the bottom wall and/or the intermediate wall extend(s) substantially horizontally.

According to an embodiment of the invention, the second tubular element is provided on the intermediate wall.

According to an embodiment of the invention, the second tubular element protrudes from an upper face of the intermediate wall, and particularly extends upwardly from the upper face of the intermediate wall.

According to an embodiment of the invention, the first tubular element extends downwardly from a lower face of the intermediate wall.

According to an embodiment of the invention, the side wall of the discharge muffler arrangement has a globally cylindrical shape.

According to an embodiment of the invention, the first tubular element protrudes from a lower face of the bottom wall.

According to an embodiment of the invention, the discharge muffler arrangement includes a top wall, the outlet chamber being delimited by the top wall, the side wall and the intermediate wall, the intermediate wall separating the expansion chamber and the outlet chamber.

According to an embodiment of the invention, the discharge muffler arrangement includes a muffler body comprising the bottom wall, the top wall, the side wall and the intermediate wall. Advantageously, the intermediate wall is arranged within an inner volume of the muffler body.

According to an embodiment of the invention, the expansion chamber is annular and surrounds the first tubular element.

According to an embodiment of the invention, the scroll compressor further includes an intermediate part which fluidly connects the discharge passage formed in the fixed scroll with the muffler inlet in a continuous manner. Such provisions avoid turbulences and pressure losses of the compressed refrigerant gas between the fixed scroll and the discharge muffler arrangement, and contributes to increase the overall efficiency of the scroll compressor.

According to an embodiment of the invention, the intermediate part is arranged in the discharge passage.

According to an embodiment of the invention, the intermediate part includes a refrigerant guiding portion having an inner circumferential surface which converges towards the muffler inlet and which is configured to guide a compressed refrigerant gas flow, flowing through the discharge passage, towards the muffler inlet.

According to an embodiment of the invention, the intermediate part includes a mounting portion in which is mounted, for example sealingly mounted, a lower end portion of the first tubular element, and particularly of the first tubular wall portion.

According to an embodiment of the invention, the intermediate part has a ring shape.

According to an embodiment of the invention, the discharge muffler arrangement is made in one piece.

According to an embodiment of the invention, the discharge muffler is manufactured in a polymer material compatible with the refrigerant and lubricant oil used in the scroll compressor, and which withstands the discharge temperatures occurring within the operating conditions of the scroll compressor.

According to an embodiment of the invention, the discharge muffler arrangement is made by molding or additive manufacturing methods.

According to an embodiment of the invention, the discharge muffler arrangement includes reinforcing structures, e.g. reinforcement ribs, provided on an outer surface of at least one muffler part of the discharge muffler arrangement, e.g. on outer surfaces of the top wall, the bottom wall and/or the side wall, to further minimize vibration of said at least one muffler part and transmission of acoustic noise to the outside of the compressor shell.

These and other advantages will become apparent upon reading the following description in view of the drawing attached hereto representing, as non-limiting examples, two embodiments of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiments disclosed.

DETAILED DESCRIPTION

Figure 1:
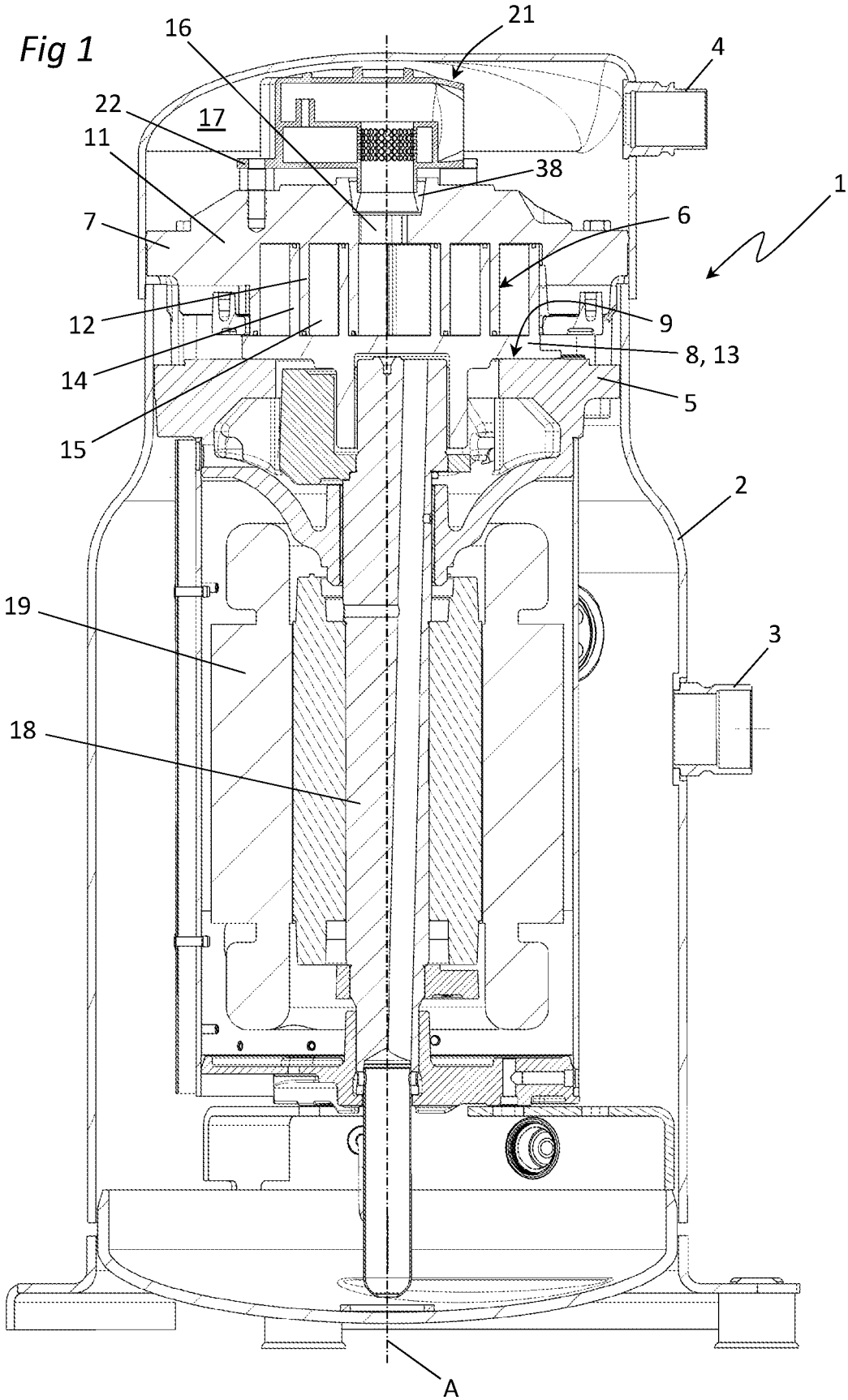
FIG. 1 is a longitudinal section view of a scroll compressor according to a first embodiment of the invention.

FIG. 1 describes a scroll compressor 1 according to the invention occupying a vertical position.

The scroll compressor 1 includes a compressor shell 2 provided with a suction inlet 3 configured to supply the scroll compressor 1 with refrigerant to be compressed, and with a discharge outlet 4 configured to discharge compressed refrigerant. The discharge outlet 4 is advantageously provided on a side wall of an upper cap of the compressor shell 2.

The scroll compressor 1 further includes a support arrangement 5 fixed to the compressor shell 2, and a compression unit 6 arranged within the compressor shell 2 and supported by the support arrangement 5. The compression unit 6 is configured to compress the refrigerant supplied by the suction inlet 3. The compression unit 6 includes a fixed scroll 7, which is fixed in relation to the compressor shell 2, and an orbiting scroll 8 supported by and in slidable contact with a thrust bearing surface 9 provided on the support arrangement 5.

The fixed scroll 7 includes a fixed base plate 11 having a lower face oriented towards the orbiting scroll 8, and an upper face opposite to the lower face of the fixed base plate 11. The fixed scroll 7 also includes a fixed spiral wrap 12 projecting from the lower face of the fixed base plate 11 towards the orbiting scroll 8.

The orbiting scroll 8 includes an orbiting base plate 13 having an upper face oriented towards the fixed scroll 7, and a lower face opposite to the upper face of the orbiting base plate 13 and slidably mounted on the thrust bearing surface 9. The orbiting scroll 8 also includes an orbiting spiral wrap 14 projecting from the upper face of the orbiting base plate 13 towards the fixed scroll 7. The orbiting spiral wrap 14 of the orbiting scroll 8 meshes with the fixed spiral wrap 12 of the fixed scroll 7 to form a plurality of compression chambers 15 between them. Each of the compression chambers 15 has a variable volume which decreases from the outside towards the inside, when the orbiting scroll 8 is driven to orbit relative to the fixed scroll 7.

The fixed scroll 7 further comprises a discharge passage 16 which is formed in a central part of the fixed base plate 11 and which is fluidly connected to the compression chambers 15. The discharge passage 16 is also fluidly connected to a discharge pressure volume 17 defined by the compressor shell 2 and the fixed scroll 7.

Furthermore, the scroll compressor 1 includes a drive shaft 18 which extends vertically and which is configured to drive the orbiting scroll 8 in an orbital movement, and an electric driving motor 19, which may be for example a variable-speed electric driving motor, coupled to the drive shaft 18 and configured to drive in rotation the drive shaft 18 about a rotation axis A.

The scroll compressor 1 also includes a discharge muffler arrangement 21 arranged in the discharge pressure volume 17 such that a clearance is defined between the upper cap of the compressor shell 2 and an upper surface of the discharge muffler arrangement 21. Advantageously, the discharge muffler arrangement 21 is attached to the fixed scroll 7, and particularly to the fixed base plate 11, for example by use of screws or bolts. However, other suitable methods, e.g. welding, brazing or gluing may be applied to attach the discharge muffler arrangement 21 to the fixed scroll 7. The discharge muffler arrangement 21 may include a plurality of attachment tabs 22 which are secured to the fixed scroll 7.

The discharge muffler arrangement 21 includes a muffler body 23 having for example a globally cylindrical shape, and being made in one piece. The muffler body 23 may be manufactured in a polymer material compatible with the refrigerant and lubricant oil used in the scroll compressor 1, and which withstands the discharge temperatures occurring within the operating conditions of the scroll compressor 1. Advantageously, the muffler body 23 is made by molding or additive manufacturing methods.

The muffler body 23 includes a bottom wall 24, a top wall 25, also named top cover, opposite the bottom wall 24 and a side wall 26 connecting the bottom wall 24 to the top wall 25. The muffle body also includes an intermediate wall 27 arranged within an inner volume of the muffler body 23 defined by the bottom wall 24, the top wall 25 and the side wall 26. The intermediate wall 27 is particularly arranged between the bottom wall 24 and the top wall 25, and is substantially parallel to the bottom wall 24. According to the embodiment shown on the figures, the bottom wall 24 and the intermediate wall 27 extend horizontally.

The discharge muffler arrangement 21 also includes a first tubular element 28 having a first open end defining a muffler inlet 29 fluidly connected to the discharge passage 16, and a second open end which is remote from the muffler inlet 29. The first tubular element 28 may have a circular cross-section.

The first tubular element 28 particularly comprises a first tubular wall portion 28.1 adjacent to the muffler inlet 29 and delimiting an inlet chamber 31, and a second tubular wall portion 28.2 comprising apertures 32. Advantageously, the first tubular element 28 extends downwardly from a lower face of the intermediate wall 27 and protrudes from a lower face of the bottom wall 24.

The discharge muffler arrangement 21 further includes an expansion chamber 33 delimited by the bottom wall 24, the side wall 26, the first tubular element 28 and the intermediate wall 27. The expansion chamber 33 is fluidly connected to an inner volume of the first tubular element 28 via the apertures 32 which open into the expansion chamber 33.

Advantageously, the expansion chamber 33 is annular and surrounds the first tubular element 28.

Furthermore, the discharge muffler arrangement 21 includes an outlet chamber 34 delimited by the top wall 25, the side wall 26 and the intermediate wall 27 of the muffler body 23. The outlet chamber 34 is located above the expansion chamber 33, and the intermediate wall 27 separates the outlet chamber 34 from the expansion chamber 33.

Figure 2:
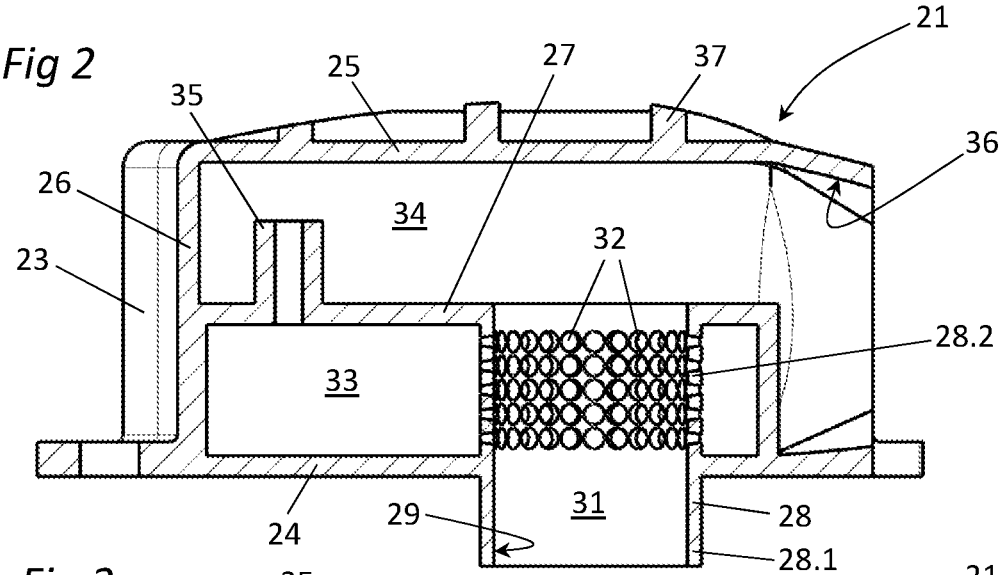
FIG. 2 is a longitudinal section view of a discharge muffler arrangement of the scroll compressor of FIG. 1.
Figure 3:
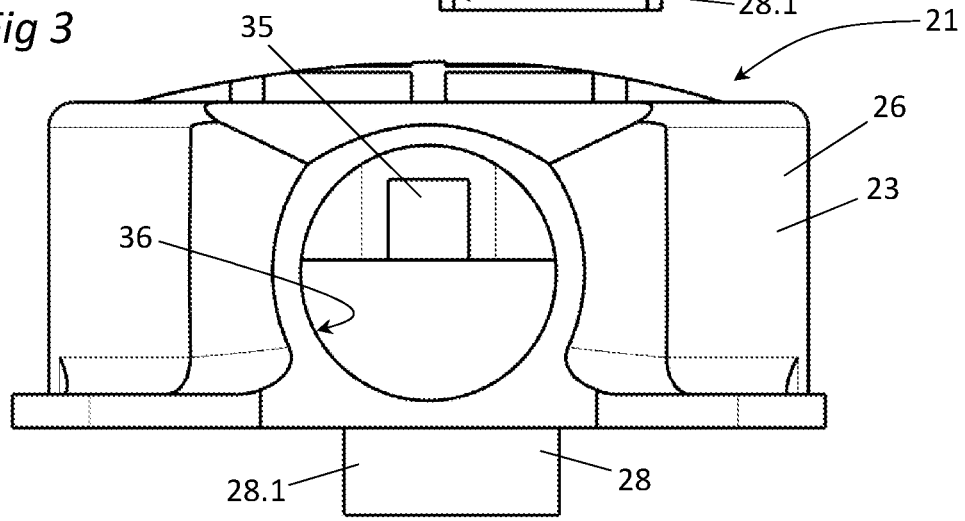
FIG. 3 is a front view of the discharge muffler arrangement of FIG. 2.
Figure 4:
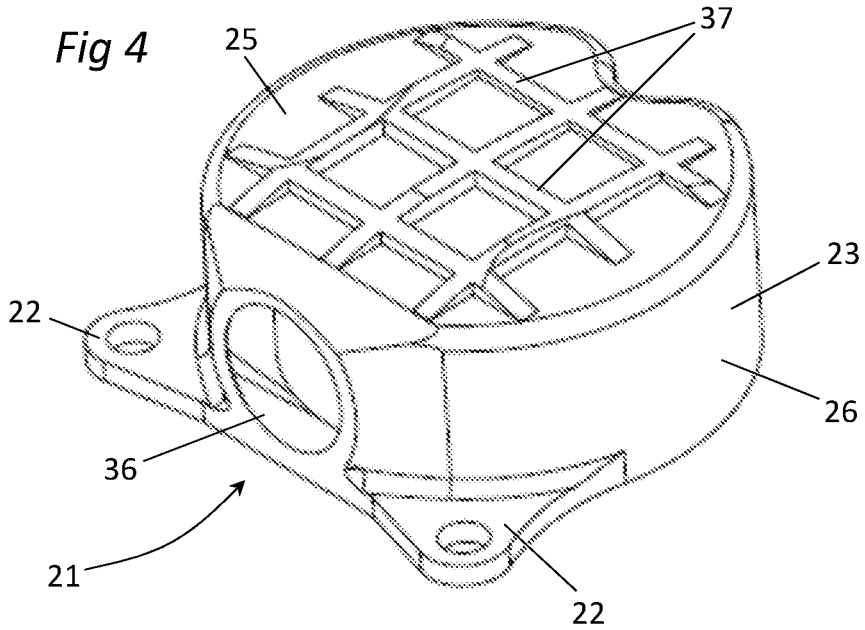
FIG. 4 is a perspective view of the discharge muffler arrangement of FIG. 2.
Figure 5:
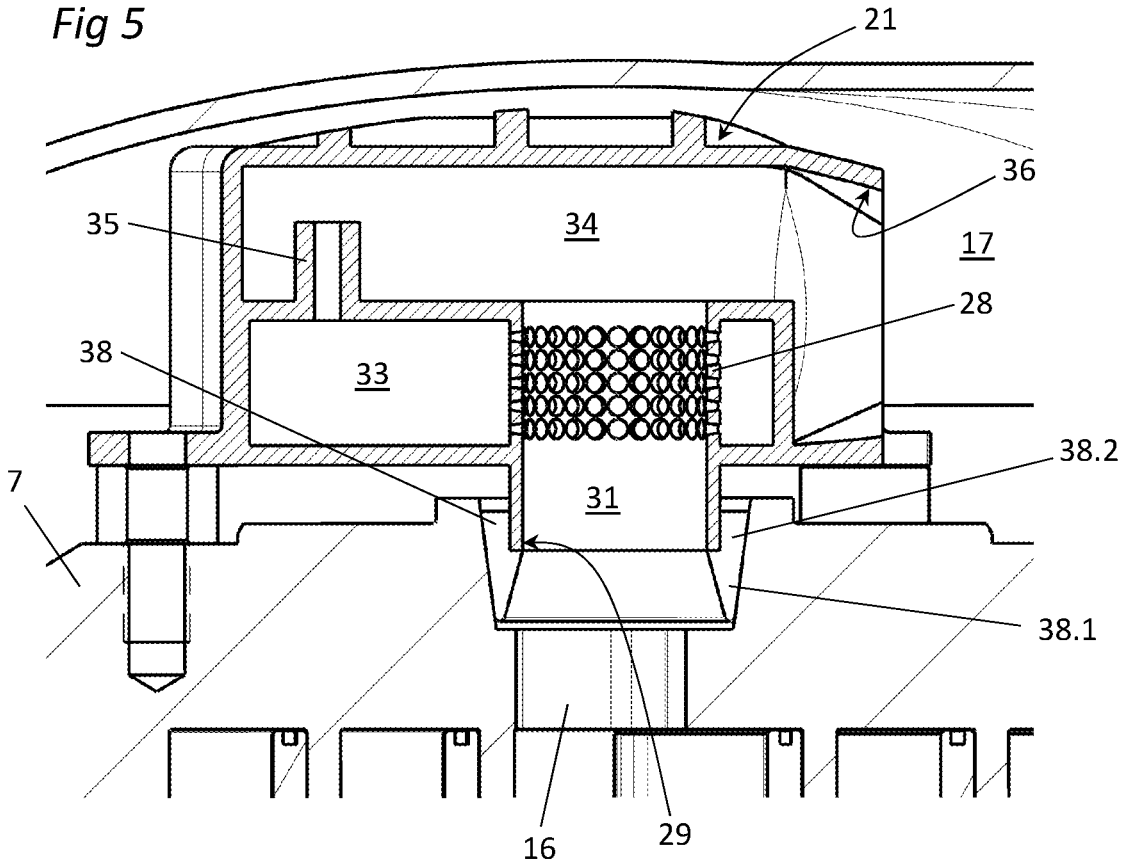
FIG. 5 is an enlarged view of a detail of FIG. 1.

As better shown on FIG. 2, the second open end of the first tubular element 28 opens into the outlet chamber 34, and the discharge muffler arrangement 21 includes a second tubular element 35 which is provided on the intermediate wall 27 and which fluidly communicates the expansion chamber 33 with the outlet chamber 34. The second tubular element 35 includes a first open end defining an inlet opening emerging in the expansion chamber 33, and a second open end defining an outlet opening emerging in the outlet chamber 34.

According to the embodiment shown on the figures, the second tubular element 35 has a circular cross-section, is arranged in the outlet chamber 34, and extends upwardly from the upper face of the intermediate wall 27. Advantageously, the first tubular element 28 and the second tubular element 35 extend vertically.

The outlet chamber 34 is provided with a muffler outlet 36 emerging in the discharge pressure volume 17 at a predetermined separating distance from the discharge outlet 4 to allow communication between the discharge pressure volume 17 and a compressed refrigerant gas flow emerging from the muffler outlet 36. Advantageously, the muffler outlet 36 is directed towards the discharge outlet 4 provided on the compressor shell 2.

According to the embodiment shown on the figure, the discharge muffler arrangement 21 includes reinforcing structures 37, e.g. reinforcement ribs, provided on an outer surface of at least one muffler part of the discharge muffler arrangement 21, e.g. on outer surfaces of the top wall 25, the bottom wall 24 and/or the side wall 26, to further minimize vibration of said at least one muffler part and transmission of acoustic noise to the outside of the compressor shell 2.

The scroll compressor 1 further includes an intermediate part 38 which fluidly connects the discharge passage 16 formed in the fixed scroll 7 with the muffler inlet 29 in a continuous manner. According to the embodiment shown on the figures, the intermediate part 38 has a ring shape and is arranged, for example firmly fitted, in the discharge passage 16. Particularly, the intermediate part 38 includes:

- a refrigerant guiding portion 38.1 having an inner circumferential surface which converges towards the muffler inlet 29 and which is configured to guide a compressed refrigerant gas flow, flowing through the discharge passage 16, towards the muffler inlet 29, and
- a mounting portion 38.2 in which is mounted, for example sealingly mounted, a lower end portion of the first tubular element 28, and particularly of the first tubular wall portion 28.1.

The operation of the scroll compressor 1 will now be described.

When the scroll compressor 1 according to the invention is turned on, the orbiting scroll 8 is driven by the drive shaft 18 following an orbital movement, this movement of the orbiting scroll 8 causing an intake and compression of refrigerant in the compression chambers 15. The compressed refrigerant gas flow exits the compression unit 6 through the discharge passage 16 formed in the central part of the fixed scroll 7, and enters the discharge muffler arrangement 21 via the muffler inlet 29. Then, a first part of the compressed refrigerant gas flow, entering the discharge muffler arrangement 21, flows through the first tubular element 28, enters the outlet chamber 34 and exits the discharge muffler arrangement 21 via the muffler outlet 36. A second part of the compressed refrigerant gas, entering the discharge muffler arrangement 21, enters the expansion chamber 33 via the apertures 32 provided on the first tubular element 28, expands in the expansion chamber 33, enters the outlet chamber 34 via the second tubular element 35, and exits the discharge muffler arrangement 21 via the muffler outlet 36. Said first and second part of the compressed refrigerant gas flow are then directed towards the discharge outlet 4, provided on the compressor shell 2, by the muffler outlet 36.

Such a configuration of the discharge muffler arrangement 21 provides an improved acoustic noise damping through scattering, reflections and interference of sound waves within the discharge muffler arrangement 21, while reducing the pressures losses within the discharge muffler arrangement 21.

Also hereby, a more smooth and direct flow from the discharge muffler arrangement 21 towards the discharge outlet 4 with minimized turbulences and pressure losses is created, which contributes to further improve the efficiency of the scroll compressor 1. Further, the relatively hot and pulsating compressed refrigerant gas flow is prevented from directly hitting the inner surface of the upper cap of the compressor shell 2, thereby further reducing the acoustic noise generated by the scroll compressor 1 and reducing the outer surface temperature of said upper cap.

Figure 6:
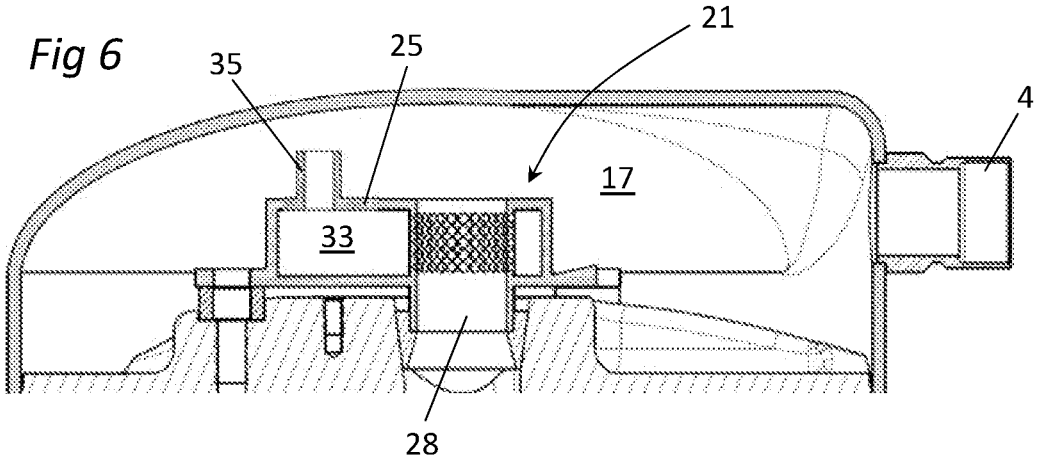
FIG. 6 is a partial longitudinal section view of a scroll compressor according to a second embodiment of the invention.

FIG. 6 discloses a scroll compressor 1 according to a second embodiment of the invention which differs from the first embodiment shown on FIGS. 1 to 5 essentially in that the discharge muffler arrangement 21 is devoid of an outlet chamber, and in that the second open end of the first tubular element 28 opens into the discharge pressure volume 17 and the outlet opening of the second tubular element 35 opens into the discharge pressure volume 17.

According to such an embodiment of the invention, the expansion chamber 33 is delimited by the bottom wall 24, the side wall 26, the first tubular element 28 and the top wall 25.

Of course, the invention is not restricted to the embodiments described above by way of non-limiting examples, but on the contrary it encompasses all embodiments thereof.

The invention claimed is:

1. A scroll compressor including:

a compressor shell having a discharge outlet, an orbiting scroll arranged within the compressor shell and comprising an orbiting base plate and an orbiting spiral wrap extending from the orbiting base plate, a fixed scroll arranged within the compressor shell and comprising a fixed base plate and a fixed spiral wrap extending from the fixed base plate, the fixed and orbiting spiral wraps defining, with the fixed and orbiting base plates, compression chambers, the fixed scroll further comprising a discharge passage which is formed in the fixed base plate, a discharge pressure volume at least partially defined by the compressor shell and the fixed scroll, a discharge muffler arrangement attached to the fixed scroll and arranged in the discharge pressure volume, wherein the discharge muffler arrangement includes a first tubular element provided with a muffler inlet fluidly connected to the discharge passage, wherein the first tubular element includes a first open end defining the muffler inlet and a second open end which is remote from the muffler inlet and which is fluidly connected to the discharge pressure volume, an expansion chamber fluidly connected to an inner volume of the first tubular element through apertures formed in the first tubular element, wherein the inner volume is a volume between the muffler inlet and the second open end of the first tubular element, and a second tubular element including an inlet opening emerging in the expansion chamber and an outlet opening fluidly connected to the discharge pressure volume; and wherein the second open end of the first tubular element opens into the discharge pressure volume.

2. The scroll compressor according to claim 1, wherein the first tubular element comprises a first tubular wall portion adjacent to the muffler inlet and delimiting an inlet chamber, and a second tubular wall portion comprising the apertures, the apertures opening into the expansion chamber.

3. The scroll compressor according to claim 1, wherein the outlet opening of the second tubular element opens into the discharge pressure volume.

4. The scroll compressor according to claim 1, wherein the expansion chamber is annular and surrounds the first tubular element.

5. The scroll compressor according to claim 1, further including an intermediate part which fluidly connects the discharge passage formed in the fixed scroll with the muffler inlet in a continuous manner.

6. The scroll compressor according to claim 5, wherein the intermediate part is arranged in the discharge passage.

7. The scroll compressor according to claim 5, wherein the intermediate part includes a refrigerant guiding portion having an inner circumferential surface which converges towards the muffler inlet and which is configured to guide a compressed refrigerant gas flow, flowing through the discharge passage, towards the muffler inlet.

8. The scroll compressor according to claim 5, wherein the intermediate part includes a mounting portion in which is mounted a lower end portion of the first tubular element.

9. The scroll compressor according to claim 1, wherein the discharge muffler arrangement is made in one piece.

10. A scroll compressor including:

a compressor shell having a discharge outlet, an orbiting scroll arranged within the compressor shell and comprising an orbiting base plate and an orbiting spiral wrap extending from the orbiting base plate, a fixed scroll arranged within the compressor shell and comprising a fixed base plate and a fixed spiral wrap extending from the fixed base plate, the fixed and orbiting spiral wraps defining, with the fixed and orbiting base plates, compression chambers, the fixed scroll further comprising a discharge passage which is formed in the fixed base plate, a discharge pressure volume at least partially defined by the compressor shell and the fixed scroll, a discharge muffler arrangement attached to the fixed scroll and arranged in the discharge pressure volume, wherein the discharge muffler arrangement includes a first tubular element provided with a muffler inlet fluidly connected to the discharge passage, wherein the first tubular element includes a first open end defining the muffler inlet and a second end which is remote from the muffler inlet and which is fluidly connected to the discharge pressure volume, an expansion chamber fluidly connected to an inner volume of the first tubular element through apertures formed in the first tubular element, wherein the inner volume is a volume between the muffler inlet and the second end of the first tubular element, and a second tubular element including an inlet opening emerging in the expansion chamber and an outlet opening fluidly connected to the discharge pressure volume;

wherein the discharge muffler arrangement includes an outlet chamber provided with a muffler outlet emerging in the discharge pressure volume; and wherein the second end of the first tubular element opens into the outlet chamber.

11. The scroll compressor according to claim 10, wherein the outlet opening of the second tubular element opens into the outlet chamber.

12. The scroll compressor according to claim 10, wherein the muffler outlet is directed towards the discharge outlet provided on the compressor shell.

13. The scroll compressor according to claim 10, wherein the second tubular element is at least partially arranged in the outlet chamber.

14. The scroll compressor according to claim 10, wherein the discharge muffler arrangement includes a bottom wall, a side wall and an intermediate wall, the expansion chamber being delimited by the bottom wall, the side wall, the first tubular element and the intermediate wall.

15. The scroll compressor according to claim 14, wherein the discharge muffler arrangement includes a top wall, the outlet chamber being delimited by the top wall, the side wall and the intermediate wall, the intermediate wall separating the expansion chamber and the outlet chamber.

16. The scroll compressor according to claim 10, wherein the discharge muffler arrangement includes reinforcing structures provided on an outer surface of at least one muffler part of the discharge muffler arrangement, to further minimize vibration of said at least one muffler part and transmission of acoustic noise to an outside of the compressor shell.

17. The scroll compressor according to claim 10, wherein the second tubular element is at least partially arranged in the outlet chamber.

18. The scroll compressor according to claim 10, wherein the expansion chamber is annular and surrounds the first tubular element.

* * * * *